US005181352A

United States Patent [19]

Friedman

[11] Patent Number: 5,181,352

[45] Date of Patent: Jan. 26, 1993

[54] RAIN CAP SYSTEM FOR FAST MODULAR STRUCTURES

[76] Inventor: Michael Friedman, 528 Winston Ave., Bradbury, Calif. 91010

[21] Appl. No.: 659,026

[22] Filed: Feb. 21, 1991

[51] Int. Cl.[5] ..... E04B 1/32; E04H 15/42

[52] U.S. Cl. ..... 52/58; 52/63; 52/86; 52/726.1; 52/728

[58] Field of Search ..... 52/726, 469, 60, 63, 52/86, 235, 300, 465, 728, 731, 585, 781, 282, 58, 222; 135/120, 908

[56] References Cited

U.S. PATENT DOCUMENTS

| | | | |
|---|---|---|---|
| 1,610,246 | 12/1926 | Bonsall | 52/469 |
| 1,654,573 | 1/1928 | Bonsall | 52/469 |
| 2,095,434 | 10/1937 | Calkins et al. | 52/469 |
| 2,855,871 | 10/1958 | Huntington | 52/469 |
| 3,021,927 | 2/1962 | McKee, Jr. | 411/34 X |
| 3,802,140 | 4/1974 | Hickman | 52/300 |
| 3,867,799 | 2/1975 | Pryor et al. | 52/235 |
| 3,958,373 | 5/1976 | Stewart et al. | 52/58 |
| 3,982,360 | 9/1976 | Newmann | 52/90 X |
| 4,593,710 | 6/1986 | Stafford et al. . | |
| 4,644,706 | 2/1987 | Stafford et al. . | |
| 4,841,688 | 6/1989 | Rinaldi | 52/63 |

OTHER PUBLICATIONS

Canvas Specialty, "F.A.S.T. Structures-What We Are All About".

*Primary Examiner*—David A. Scherbel
*Assistant Examiner*—Robert Canfield
*Attorney, Agent, or Firm*—Merchant, Gould, Smith, Edell, Welter & Schmidt

[57] ABSTRACT

A rain cap system which keeps rain, snow, wind, dirt, dust, and other elements from penetrating the assembly junctions of Fast Structures TM. Four gaskets are placed (one each) on the four structural bolts at each junction of the Fast Structure TM and a rain cap is snapped into place completely covering each junction. The rain cap squeezes the Fast Structure TM junction to seal out the weather and to hold itself in place, and thus does not require nuts, screws, bolts, glue nor any other fastening devices.

5 Claims, 3 Drawing Sheets

FIG. 5
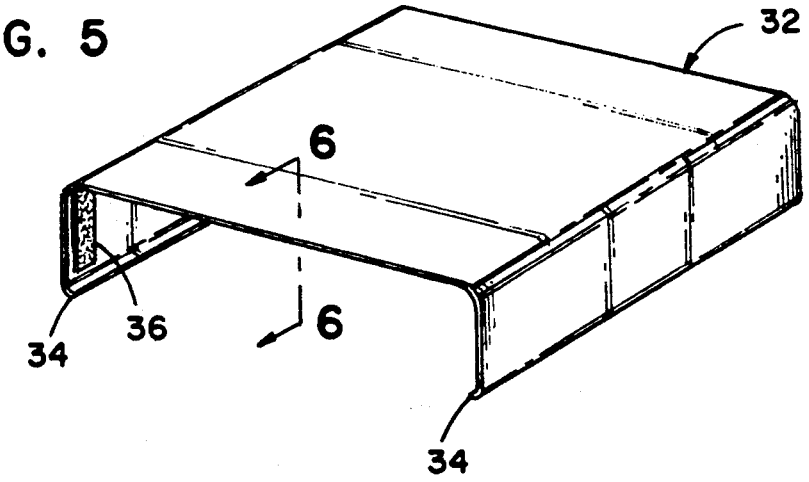
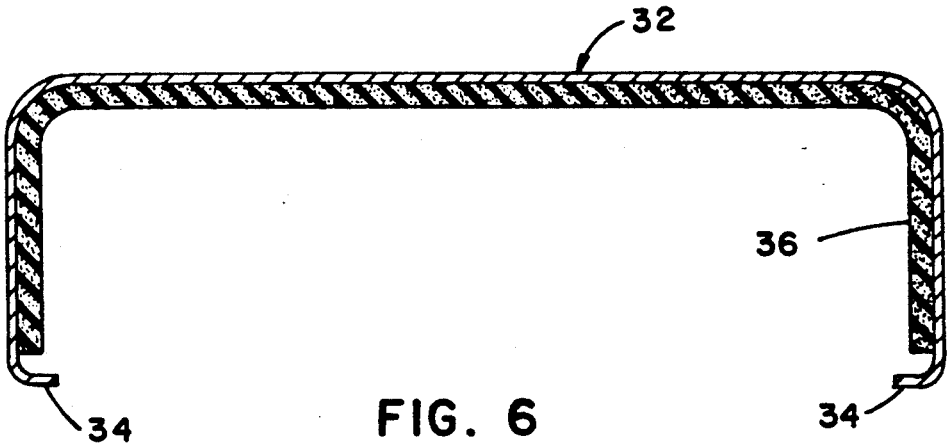
FIG. 6
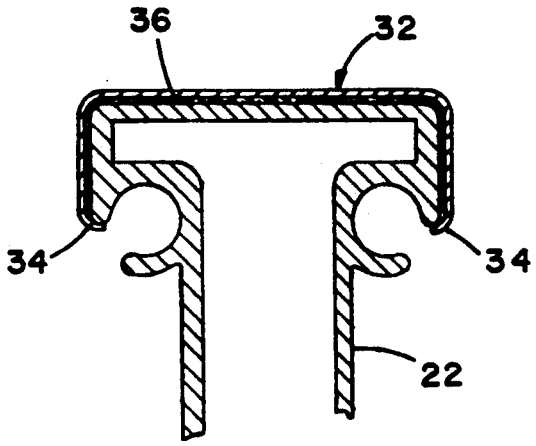
FIG. 7

RAIN CAP SYSTEM FOR FAST MODULAR STRUCTURES

BACKGROUND OF THE INVENTION

1. Field of the Invention

This invention relates in general to fabric covered building structures, and in particular to a rain cap system therefor.

2. Description of Related Art

"FAST Structure TM" buildings are portable, rapidly-erected, fabric covered building structures. A description of these structures can be found in U.S. Pat. Nos. 4,593,710 issued Jun. 10, 1986, to Stafford et al. and U.S. Pat. No. 4,644,706 issued Feb. 24, 1987 to Stafford et al, both of which patents are incorporated herein by reference. The structure has a plurality of articulated arch frames which are supported in longitudinally spaced, transversely extending vertical positions. Spreaders rigidly connect the arch frames. A plurality of fabric panels are each connected between a corresponding pair of adjacent arches.

Element invasion is a problem for Fast Structure TM buildings. Water has a tendency to invade the structure and drip inside. One aspect of the present invention was the discovery that water invades the structure at junction points and bolt apertures, then travels through the hollow portion of the arch frames to a next junction point where it leaks through to the inside of the structure. Prior attempts to halt these leaks included the application of duct tape over the exterior portions of the junction points and bolt apertures. Prior art weather protecting devices that are used on homes and commercial buildings, such as "flashings", are not designed in the same way or shape as the Fast Structures TM, and consequently cannot be used therewith.

SUMMARY OF THE INVENTION

To overcome the limitations in the prior art described above, and to overcome other limitations that will become apparent upon reading and understanding the present specification, the present invention discloses a rain cap system which keeps rain, snow, wind, dirt, dust, and other elements from penetrating the assembly junctions of Fast Structures TM. The present invention has been designed to work in conjunction with temporary and permanent buildings built using Fast Structure TM components. The present invention comprises four round gaskets and one rain cap. The four gaskets are placed (one each) on the four structural bolts at each junction of the Fast Structure TM and the rain cap is snapped into place completely covering each junction. The rain cap squeezes the Fast Structure TM junction to seal out the weather and to hold itself in place, and thus does not require nuts, screws, bolts, glue nor any other fastening devices.

BRIEF DESCRIPTION OF THE DRAWINGS

Referring now to the drawings in which like reference numbers represent corresponding parts throughout:

FIG. 5 is a perspective view of a rain cap according to the present invention;

FIG. 6 is a side view of the rain cap showing the neoprene cladding attached to the inside thereof; and FIG. 7 is a cross-section side view of a portion of one of the arches with the rain cap fitted thereto;

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

The present invention works in coordination with temporary and permanent buildings constructed using Fast Structures TM. The present invention can also be readjusted to fit any other application where the same primary function is required. The primary function of the rain cap system is to prevent rain, snow, sleet, hail, water, dirt, dust, wind or any other elements from penetrating the Fast Structure TM junctions.

Figure 1:
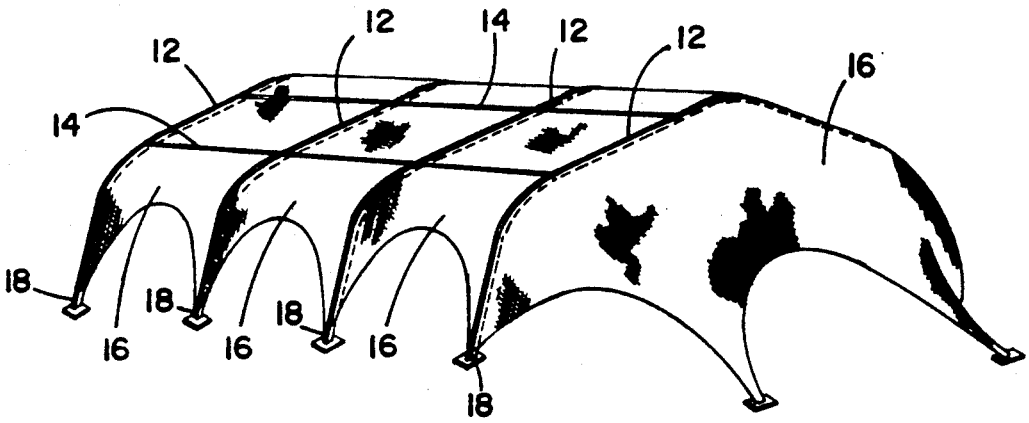
FIG. 1 is a perspective view of a building structure.
Figure 2:
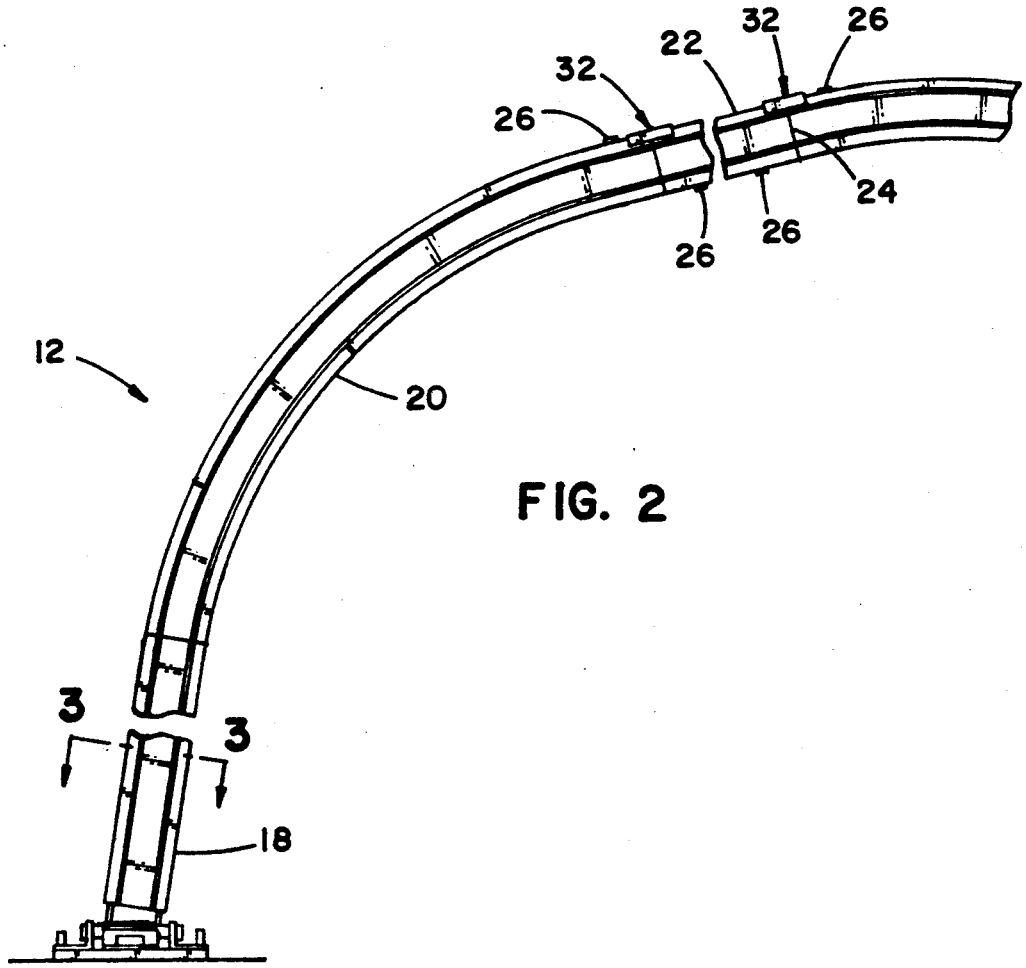
FIG. 2 is an enlarged, fragmentary side elevation view of a portion of an arch used in the building structure.

FIG. 1 is a perspective view of a Fast Structure TM 10. FIG. 2 is an enlarged, fragmentary side elevation view of a portion of an arch 12 used in the structure 10. Spreaders 14 rigidly connect the arches 12. A plurality of rectangular fabric panels 16 made of a flexible web material form the main covering of the structure 10. The fabric panels 16 are each connected between a corresponding pair of adjacent arches 12. Each of these sections 16 has a width corresponding to the longitudinal distance between adjacent ones of the arches 12 and a length corresponding to the transverse extension of the arches 12. In other words, each rectangular fabric panel 16 extends from ground level on one side of the structure 10 to ground level on the other side of the structure 10. Each arch 12 is comprised of a plurality of hollow extruded aluminum box beam segments such as 18, 20, and 22, which are joined end-to-end. The shape of the box beam segments, i.e., straight, slightly curved, etc., are selected to achieve both the span, pitch and profile suited to the particular usage, snow load, and other design perimeters.

Figure 3:
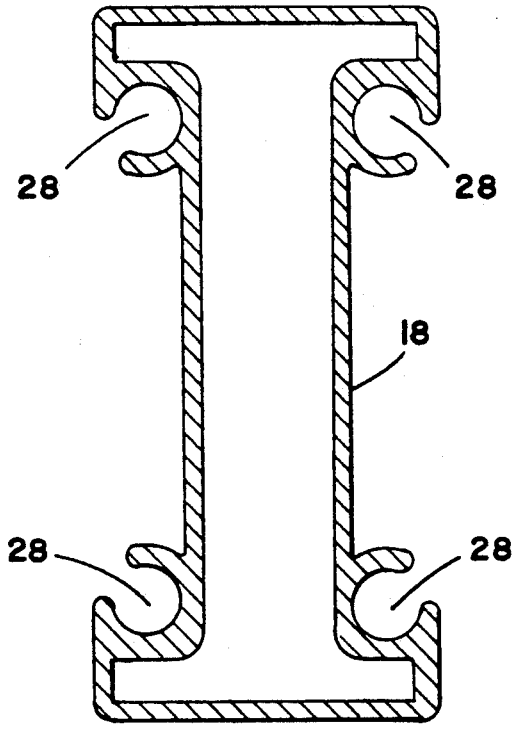
FIG. 3 is a cross-sectional, end perspective view of a portion of one of a beam segment.

FIG. 3 is a cross-sectional, end perspective view of a portion of a beam segment 18, illustrating that each box beam segment 18 is formed with pairs of longitudinally extending outwardly opening rounded slots 28 on opposite sides thereof. The transverse edges of the fabric panels 16 have nylon ropes stitched, hemmed, or otherwise connected thereto. These ropes have a length in diameter such that they can be snugly threaded through corresponding ones of the slots 28 to attach the edges of the fabric panels 16 to corresponding arches 12. The box beam segments 18 are hollow and have an interior configuration that accepts I-beam steel moment slices. The steel moment slices fit within adjacent ends of meeting box beam segments 18 and are held together in position with bolts 26 that extend through the box beam segments 18 and the steel moment slices.

Figure 4:
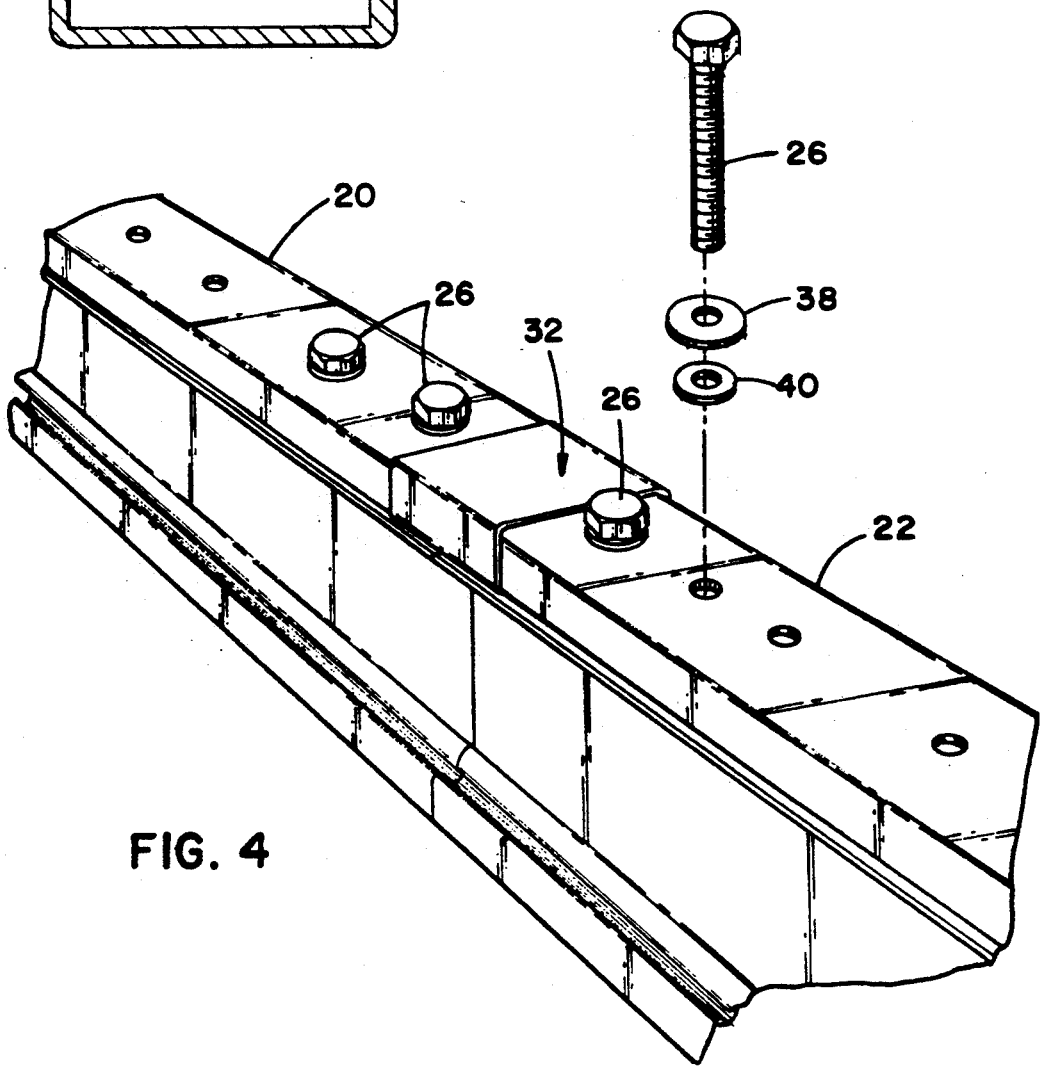
FIG. 4 is an enlarged view of a portion of the arch frame of FIG. 2, illustrating the joining of the beam segments using structural bolts.

FIG. 4 is an enlarged perspective view of a portion of the arch 12 of FIG. 2, illustrating the joining of the beam segments 20 and 22 using structural bolts 26. Steel moment slices fit within adjacent ends of meeting box beam segments 20 and 22 and are held together in position with bolts 26. Element invasion is a problem at the connection point of the arches at the ends of meeting box beam segments 20 and 22. The present invention solves this problem by providing a rain cap 32. The rain cap 32 is applied to cover the junction of the box beam segments 20 and 22. In addition, a gasket 40 is applied to each one of the four bolts 26.

Each structural bolt 26 is fitted with a gasket 40 interposed between the box beam segment and a flat washer 38. The gasket 40 is comprised of ⅛ inch thick polyethylene closed cell foam. The gasket is crushed as it is compressed by tightening the bolt 26 and washer 38 arrangement, whereupon the gasket 40 fills the junction between the bolts 26 and the apertures therefor in the box beam segments. The gasket 40 thereby prevents water from seeping into the hollow interior of the arches 12. Further, the gaskets are inexpensive to manufacture and thus are disposable after one or a few uses. The combination of the rain cap 32 and the gaskets 40 prevents all known leaks in Fast Structures TM.

FIG. 5 is a perspective view of a rain cap 32 according to the present invention. The rain cap 32 is a specially shaped piece of aluminum conformed to cover the junction of box beam segments, thus sealing out the elements. The rain cap 32 measures 5 inches long by 4 inches wide by 1 11/16 inches high. The rain cap 32 is held in place by the spring tension of the metal, which allows the rain cap 32 to grip the box beam segment by means of two lips 34.

FIG. 6 is a side view of the rain cap 32 showing the neoprene cladding 36 attached to the inside thereof. The cladding 36 is comprised of a ⅛ inch layer of closed-cell neoprene. Preferably, the cladding 36 is attached to the rain cap 32 by means of a double-sided pressure sensitive tape (not shown) and is placed within ⅛ inch of the edge of the rain cap 32.

FIG. 7 is a cross-section side view of a portion of one of the box beam 18 with the rain cap 32 fitted thereto. The rain cap 32 is held in place by gripping the box beam segment 18 with the two lips 34. The cladding 36 is crushed as the rain cap grips the box beam segment 18, thereby ensuring a watertight fit and preventing water from seeping into the hollow interior of the box beam segment 18.

In summary, a rain cap system has been described which prevents the invasion of water into joints of a Fast Structure TM. The four gaskets are placed (one each) on the four structural bolts at each junction of the Fast Structure TM and the rain cap is snapped into place completely covering each junction. The rain cap squeezes the Fast Structure TM junction to seal out the weather and to hold itself in place, and thus does not require nuts, screws, bolts, glue nor any other fastening devices.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. An apparatus for preventing weather elements from penetrating the assembly junctions of a temporary building structure, comprising an arched frame comprised of I beam segments joined end to end, wherein each I-beam segment is formed with a top, a pair of outer walls, and a bottom, the outer walls each having a longitudinally extending, outwardly opening rounded slot therein, and a rain cap conformably disposed on and covering the joined end-to-end I beam segments of the arched frame, the rain cap consisting essentially of a planar first portion spanning the top of the joined I-beam segments for face to face engagement therewith and a pair of planar side flanges integrally formed with the planar first portion and extending downwardly and perpendicular from the planar first portion for face to face engagement with the respective outer walls of the joined I-beam segments, each planar side flange extending to a distance just above the rounded slot in the respective outer walls of the joined I-beam segments, each planar side flange being terminated in a lip turned inwardly therefrom to engage an edge of the rounded slot in the outer walls of the joined I-beam segments, the rain cap extending along a longitudinal length of the arched frame for a distance less than a total length of the arched frame sufficient to cover the joined ends of the I-beam segments.

2. The apparatus of claim 1, wherein the inner portion of the rain cap adjacent the joined I-beam segments is covered by a cladding attached thereto to form a weather-resistant seal.

3. The apparatus of claim 2, wherein the cladding is comprised of a layer of closed-cell neoprene.

4. The apparatus of claim 3, wherein the cladding is attached to the rain cap by means of a double-sided pressure sensitive tape.

5. The apparatus of claim 1, wherein the rain cap is held in place by spring tension.

* * * * *